US005350627A

United States Patent [19]

Nemphos et al.

[11] Patent Number: 5,350,627

[45] Date of Patent: Sep. 27, 1994

[54] COATED WEBS

[75] Inventors: Speros P. Nemphos, League City, Tex.; Gregory B. Kharas, Wilmette, Ill.

[73] Assignee: Camelot Technologies, Inc., Leominster, Mass.

[21] Appl. No.: 75,115

[22] Filed: Jun. 11, 1993

[51] Int. Cl.[5] ..... D04H 1/58

[52] U.S. Cl. ..... 428/288; 428/290; 428/913

[58] Field of Search ..... 428/288, 290, 913

[56] References Cited

U.S. PATENT DOCUMENTS 4,360,488 11/1982 Barham et al. .
4,360,583 11/1982 Engler et al. .
4,391,766 7/1983 Barham et al. .
4,477,654 10/1984 Holmes et al. .
4,910,145 3/1990 Holmes et al. .

FOREIGN PATENT DOCUMENTS 9001521 2/1990 PCT Int'l Appl. .

*Primary Examiner*—James J. Bell
*Attorney, Agent, or Firm*—Stevens, Davis, Miller & Mosher

[57] ABSTRACT

Biodegradable polymers may be used as binders for impregnating or coating fibrous webs. The resulting web is degradable and also the fibers within the web may be more easily recycled.

33 Claims, No Drawings

COATED WEBS

FIELD OF THE INVENTION

The present invention relates to fibrous webs. More particularly the present invention relates to the use of degradable binders in coating and impregnating fibrous webs, preferably cellulosic webs.

BACKGROUND OF THE INVENTION

Recently there has been increasing interest in the field of biodegradable polymers. Such polymers have been used in medical and pharmaceutical applications in the past. Typically, such polymers are polymers of one or more of lactic acid, glycolic acid, hydroxy butyric acid and hydroxy valeric acid. These type of polymers arc of interest as they degrade to "naturally" occurring by products and they arc degraded by microbes in the natural environment. Additionally as the polymers are esters they may be hydrolysed under relatively mild conditions.

WO 90/01521 published Feb. 22, 1990 discusses the lactide polymers. The patent application proposes using this type of polymer in commodity plastic applications such as molded products. The patent application does not disclose using the polymers as a binder for or in fibrous webs.

Imperial Chemical Industries PLC (ICI) have a significant patent portfolio in the field of hydroxy alkanoates such as copolymers of hydroxy butyrate and hydroxy valerate, sometimes referred to as PHBV. ICI have proposed that such polymers could be used in injection molding applications for household wares such as containers and the like. U.S. Pat. Nos. 4,477,654 issued Oct. 16, 1984; 4,910,145 issued Mar. 20, 1990; 4,391,766 issued Jul. 5, 1983; 4,360,488 issued Nov. 23, 1982; and 4,360,583 issued Nov. 9, 1982 are representative of the ICI patents. These patents relate to processes for the production of poly hydroxy butyric acid (PHB) or copolymers of hydroxy butyric acid and hydroxy valeric acid (PHBV) by growing a microorganism, extracting the polymer from the microorganism and molding the polymer. However, the patents do not suggest using the polymer as a binder in a fibrous web.

SUMMARY OF THE INVENTION

There is a need for a degradable binder which may be used for either coating or impregnating fibrous webs. The present invention seeks to provide fibrous webs comprising a polymeric binder which is degradable. More particularly the present invention seeks to provide fibrous webs either coated or impregnated with such binders.

Accordingly, the present invention provides a web of a cellulosic fiber in which at least a portion of the cellulose fibers are contacted with binder comprising one or more polymers having a molecular weight of greater than 40,000 comprising the residues of one or more monomers of the Formula:

$$-OCR_1R_2(CR_3R_4)_nCO- \quad \text{I}$$

wherein in Formula I $R_1$, $R_2$, $R_3$, and $R_4$ are independently selected from the group consisting of a hydrogen atom and a $C_{1-4}$ alkyl radical and n is 0 or an integer from 1 to 5.

In further aspects the present invention provides such webs and processes for their manufacture wherein at least one surface of the web has been contacted with a solution of said binder in an organic solvent; or an aqueous dispersion of the binder; or laminated to a film of the binder.

In further aspects the present invention provides a process for preparing the above web wherein at least one surface and/or at least a portion of the interior of the web has been impregnated with a solution of the binder in an organic solvent; or an aqueous dispersion of the binder.

DETAILED DESCRIPTION

The binder polymers suitable for use in the present invention are polymers having a molecular weight of greater than 30,000, preferably greater than 50,000 comprising the residues of one or more monomers of the Formula:

$$-OCR_1R_2(CR_3R_4)_nCO- \quad \text{I}$$

wherein in Formula I $R_1$, $R_2$, $R_3$, and $R_4$ are independently selected from the group consisting of a hydrogen atom and a $C_{1-4}$ alkyl radical and n is 0 or an integer from 1 to 5.

Typically the binder polymers will have an intrinsic viscosity of greater than 0.4, preferably greater than 1.0 as determined using ASTM D2857.

If the binder is a homopolymer and in Formula I n is 0. and one of $R_1$ and $R_2$ is a hydrogen atom and the other is a methyl radical then the polymer is polylactic acid. Typically, homopolymers of lactic acid are prepared by first forming a dimer or diester of lactic acid called a lactide. The lactide then under goes ring opening polymerization typically in the presence of a catalysts such as stannous octoate. The polymer may then be devolatilized and pelletized. It should be noted that the monomer may be in either the D or L configuration. The lactide may be in either the D, L, or meso configuration. If the polymer contains at least 80, especially more than 90 weight % of monomer in the L configuration then it will tend to be more crystalline and have a higher heat distortion temperature; for binders where improved flexibility is desired especially at low temperatures, the content of the L configuration isomer would preferably be kept at levels lower than 80%.

If the binder is a homopolymer and in Formula I n is 1, and one of one of $R_1$ and $R_2$ is a hydrogen atom and the other is a methyl radical and $R_3$ and $R_4$ are hydrogen atoms the polymer will be poly hydroxy butyrate (PHB). Typically, these polymers are prepared by cultivating microorganisms which store "food" in the form of the polymer. There are many types of microorganisms which accumulate PHB or PHBV. For example, the microorganism may be of the genus Azotobacter such as used by Dr. Page from the University of Alberta or of the genus Alcaligenes used by ICI.

If the binder is a homopolymer and in Formula I n is 1, and one of one of $R_1$ and $R_2$ is a hydrogen atom and the other is an ethyl radical and $R_3$ and $R_4$ are hydrogen atoms the polymer will be poly hydroxy valeric acid. These polymers may be produced in a manner similar to that for producing PHB. However, some selection of the substrate(s) on which the microorganism is grown may be required. Again, for binders where improved low temperature flexibility is desired, copolymer binder compositions re preferred over homopolymers to reduce crystallinity. Comonomer content of at least 20% is preferred.

The binder may be a copolymer comprising from 70 to 10, preferably from about 50 to 10, weight % of monomer residues of Formula I wherein n is 1, and one of one of $R_1$ and $R_2$ is a hydrogen atom and the other is a methyl radical and $R_3$ and $R_4$ are hydrogen atoms and from 30 to 90, preferably from 90 to 50, weight % of monomer residues of Formula I wherein n is 1, and one of one of $R_1$ and $R_2$ is a hydrogen atom and the other is an ethyl radical and $R_3$ and $R_4$ are hydrogen atoms. In which case the copolymer would be a copolymer of hydroxy butyric and hydroxy valeric acid (PHBV). These copolymers may be produced in a manner similar to that used for the production of PHB except that the substrate should also contain a precursor for the hydroxy valeric acid.

The binder may be a homopolymer of Formula I wherein n is 0, and both $R_1$ and $R_2$ are hydrogen atoms. In this case the binder would be a homopolymer of glycolic acid.

The binder may be a copolymer comprising from 70 to 30 weight % of monomer residues of Formula I wherein n is 0, and one of $R_1$ and $R_2$ is a hydrogen atom and the other is a methyl radical and from 30 to 70 weight % of monomer residues of Formula I wherein n is 0, and both $R_1$ and $R_2$ are hydrogen atoms. In this case the binder would be a copolymer of lactic acid and glycolic acid. Such polymers are usually prepared by conventional polymerization techniques.

Additional copolymer compositions based on monomers residues of fromula I, providing varying degrees of crystallinity or flexibility to the binder, are obvious to those skilled in the art.

The web is a fibrous web. The web may have a thickness from about 1 rail (e.g. paper) to about an eighth of an inch (e.g. cardboard). The fibers may be natural or synthetic or a mixture thereof. Suitable synthetic fibers include polyolefins such as polyethylene and polypropylene. The synthetic fiber may be a polyamide such as copolymers of hexamethylene diamine and adipic acid (nylon 66) or the polymerization of a lactam (nylon 6) or the polymerization of an amino carboxylic acid such as omega-aminoundecanoic acid (nylon 11). The fiber may be a polyester such as a terephthalate ester of ethylene or butylene glycol. Preferably the fiber is a cellulosic fiber derived from wood or other plants. The fiber may be bleached or unbleached. Most preferably the web is paper, either bleached paper or kraft paper.

In one embodiment of the present invention the binder may be coated onto the web as a solution in an organic solvent. Typically the solution will contain from about 1 to 50, most preferably from about 5 to 25 weight % binder. The limitation on the amount of binder in the solution is the viscosity of the solution. The uncoated paper is passed beneath a pool of the solution of solvent and binder then under a suitable coating blade, such as a bill blade, or an air knife blade or the like. Useful solvents include moderately polar solvents such as halogenated $C_{1-8}$ alkanes such as chloroform and dichloromethane.

One of the difficulties with the use of solutions of binder in organic solvents is the environmental concerns. The solvent needs to be recovered and not released to the environment. Additionally some solvents are flammable. Accordingly, the use of solutions of binder in an organic solvent may present additional capital expense for plants. An alternative is to form an aqueous dispersion or latex of the binder polymer. The polymer may be suspended in an organic diluent and the resulting suspension mixed with water and a surfactant. The system is then inverted, typically under high shear, so that the continuous phase is water. The organic diluent is then driven off. This results in an aqueous dispersion of the binder polymer. The process for making aqueous dispersions from organic systems is well known to those skilled in the art.

For fluid systems such as aqueous dispersions fillers may be incorporated. The filers serve several purposes. They extend the binder and they brighten the final surface of the web. In aqueous based systems the filler may be present in an amount from about 50 to 70, preferably from about 55 to 65 weight %. The filler may be one or more members selected from the group consisting of clay, talc, calcium carbonate and the like. The preferred filler is clay. Minor amounts of surfactant, and processing aids may also be incorporated into such systems.

At least for surface coating of the web laminating techniques may be used. A film of the binder may be prepared and laminated to the paper. The film may be cast from a solution of binder in an organic solvent or the film may be extruded directly onto the paper. If the film is prepared by casting a solution of binder in organic solvent is cast on a smooth base or a drum and the solvent is evaporated. The resulting film is then removed from the base and may be laminated to the paper surface. Typically the laminated film may have a thickness from about 1 to 30, preferably from about 5 to 20, most preferably from 5 to 15 mils thick. The paper and the film are then pressed into contact and heated. This may be accomplished by passing the paper and the film through one or more calender roll(s). The calender rolls are usually chilled. Generally there is a heat build up due to friction as the paper and film pass through the roll(s). The film should be laminated to the web a temperature above its softening point but below its melting point. The film should soften but not melt. The temperature of the film and the paper will depend on a number of factors including the number of rolls, (e.g. Calendar rolls may be stacked and the web and film are threaded through the stack) and the speed of travel of the film and the web through the roll(s). The temperature of the rolls may be adjusted accordingly. Typically the film will be exposed to temperatures in the range from about 100 to 180, preferably from about 120° to 160° C. In a commercial paper coating operation the rate of travel through the rolls will range from about 3,000 to about 4,500 feet per minute.

For extrusion coating the polymer is fed to an extruder. The extruder is operated at temperatures above the melting temperature of the polymer but at temperatures which will not degrade the polymer. Typically the extruder will operate at temperatures from about 130° to 200°, preferably from about 150° to 180° C. The screw in the extruder will operate at speeds from about 80 to 130, preferably from about 90 to 110 RPM's. Typically the screw in the extruder will have an L to D ratio from about 36:1 to 24: 1. The polymer is extruded as a melt onto the surface of the paper and the paper with the polymer melt may then pass through calender rolls to smooth and polish the coating. Typically, the speed of the web through commercial extrusion coaters is on the order of 3,000 feet per minute. The extruded coating may have a thickness from about 1 to 30 mils, preferably from 2 to 25 mils. The application weight will be in the order of about 10 to 30 g/m$^3$.

The present invention is also applicable to impregnating fibrous webs. Either solutions or aqueous dispersions of binder may be used to impregnate the web. Typically the web is passed through one or a series of baths depending the pick up of binder solution or dispersion required. Typically the binder pick up may range from about 5 to 50, preferably from about 10 to 30 weight % of the dry web. The web is then dried, usually by passing through a hot air oven. The web is heated to drive off the liquid and soften the binder so it will adhere to the fibers. The ovens may be operated at temperatures up to about 180°, preferably from about 150° to 175° C. The rate of travel of the web through the baths and oven may range from about 2,500 to 4,000 feet per minute.

Other variations of the present invention will be apparent to those skilled in the an of paper coating and/or impregnation.

The present invention will now be illustrated by the following non-limiting examples in which, unless otherwise indicated parts are parts by weight and % is weight %.

BASE POLYMER

A mixture of 80% L and 20% D,L lactide was polymerized at a temperature of about 180° C. in the presence of stannous octoate to yield a polymer comprising 90% L and 10% D lactic acid. The polymer had an intrinsic viscosity of 0.5 as determined by ASTM D 2857 (using dichloromethane as the solvent).

EXAMPLE 1:

The above base polymer was dissolved in dichloromethane to produce solutions of 1%, 5% and 10% polylactic acid. Strips of normal lined note paper were immersed in the solutions and then passed under a bill blade to give a coating 1.5 mils thick. The coated paper was air dried in the laboratory. The paper coated with the 1% solution did not show any significant coating. The papers coated with the 5 and 10% solutions had a smooth clear coat.

EXAMPLE 2:

The solutions of example I were drawn down on a glass plate using a bill blade. The samples were drawn down at thicknesses of 1.5 and 6 mils (wet). The samples were air dried overnight in the laboratory. The samples resulting form the 5 and 10% solutions were clear and had sufficient integrity to be removed from the glass plate.

What is claimed is:

1. A web of a cellulosic fiber in which at least a portion of the cellulose fibers are contacted with binder comprising one or more polymers having a molecular weight of greater than 30,000 comprising the residues of one or more monomers of the Formula:

$$-OCR_1R_2(CR_3R_4)_nCO- \quad \text{I}$$

wherein in Formula I $R_1$, $R_2$, $R_3$, and $R_4$ are independently selected from the group consisting of a hydrogen atom and a $C_{1-4}$ alkyl radical and n is 0 or an integer from 1 to 5.

2. The web according to claim 1, wherein the portion of the web contacted with said binder is at least one surface of the web.

3. The web according to claim 2, wherein said binder comprises a polymer of Formula I wherein n is 0, and one of $R_1$ and $R_2$ is a hydrogen atom and the other is a methyl radical.

4. The web according to claim 2, wherein said binder comprises a copolymer or blend comprising from 70 to 10 weight % of monomer residues of Formula I wherein n is 0, and one of one of $R_1$ and $R_2$ is a hydrogen atom and the other is a methyl radical and from 30 to 90 weight % of monomer residues of Formula I wherein n is 1.

5. The web according to claim 2, wherein said binder comprises a copolymer comprising from 70 to 30 weight % of monomer residues of Formula I wherein n is 0, and one of $R_1$ and $R_2$ is a hydrogen atom and the other is a methyl radical and from 30 to 70 weight % of monomer residues of Formula I wherein n is 0, and both $R_1$ and $R_2$ are hydrogen atoms.

6. The web according to claim 1 wherein the portion of the web contacted with said binder comprises at least one surface of the web and at least a portion of the interior of the web.

7. The web according to claim 6, wherein said binder comprises a polymer of Formula I wherein n is 0, and one of $R_1$ and $R_2$ is a hydrogen atom and the other is a methyl radical.

8. The web according to claim 6, wherein said binder comprises a copolymer or blend comprising from 70 to 10 weight % of monomer residues of Formula I wherein n is 0, and one of one of $R_1$ and $R_2$ is a hydrogen atom and the other is a methyl radical and from 30 to 90 weight % of monomer residues of Formula I wherein n is 1.

9. The web according to claim 6, wherein said binder comprises a copolymer comprising from 70 to 30 weight % of monomer residues of Formula I wherein n is 0, and one of $R_1$ and $R_2$ is a hydrogen atom and the other is a methyl radical and from 30 to 70 weight % of monomer residues of Formula I wherein n is 0, and both $R_1$ and $R_2$ are hydrogen atoms.

10. A process for coating a cellulosic web with binder comprising one or more polymers having a molecular weight of greater than 30,000 comprising the residues of one or more monomers of the Formula:

$$-OCR_1R_2(CR_3R_4)_nCO- \quad \text{I}$$

wherein in Formula I $R_1$, $R_2$, $R_3$, and $R_4$ are independently selected from the group consisting of a hydrogen atom and a $C_{1-4}$ alkyl radical and n is 0 or an integer from 1 to 5 which comprises coating said web with a solution comprising from 5 to 25 weight % of said binder in an organic solvent.

11. The process according to claim 10, wherein said binder comprises a polymer of Formula I wherein n is 0, and one of $R_1$ and $R_2$ is a hydrogen atom and the other is a methyl radical.

12. The process according to claim 10, wherein said binder comprises a copolymer or blend comprising from 70 to 10 weight % of monomer residues of Formula I wherein n is 1, and one of one of $R_1$ and $R_2$ is a hydrogen atom and the other is a methyl radical and from 30 to 90 weight % of monomer residues of Formula I wherein n is 1.

13. The process according to claim 10, wherein said binder comprises a copolymer comprising from 70 to 30 weight % of monomer residues of Formula I wherein n is 0, and one of $R_1$ and $R_2$ is a hydrogen atom and the other is a methyl radical and from 30 to 70 weight % of monomer residues of Formula I wherein n is 0, and both $R_1$ and $R_2$ are hydrogen atoms.

14. A process for coating a cellulosic web with binder comprising one or more polymers having a molecular weight of greater than 30,000 comprising the residues of one or more monomers of the Formula:

$$—OCR_1R_2(CR_3R_4)_nCO— \quad I$$

wherein in Formula I $R_1$, $R_2$, $R_3$, and $R_4$ are independently selected from the group consisting of a hydrogen atom and a $C_{1-4}$ alkyl radical and n is 0 or an integer from 1 to 5 which comprises coating said web with an aqueous dispersion comprising from 20 to 70 weight % of said binder.

15. The process according to claim 14, wherein said binder comprises a polymer of Formula I wherein n is 0, and one of $R_1$ and $R_2$ is a hydrogen atom and the other is a methyl radical.

16. The process according to claim 14, wherein said binder comprises a copolymer or blend comprising from 70 to 10 weight % of monomer residues of Formula I wherein n is 0, and one of one of $R_1$ and $R_2$ is a hydrogen atom and the other is a methyl radical and from 30 to 90 weight % of monomer residues of Formula I wherein n is 1.

17. The process according to claim 14, wherein said binder comprises a copolymer comprising from 70 to 30 weight % of monomer residues of Formula I wherein n is 0, and one of $R_1$ and $R_2$ is a hydrogen atom and the other is a methyl radical and from 30 to 70 weight % of monomer residues of Formula I wherein n is 0, and both $R_1$ and $R_2$ are hydrogen atoms.

18. A process for impregnating a cellulosic web with binder comprising one or more polymers having a molecular weight of greater than 30,000 comprising the residues of one or more monomers of the Formula:

$$—OCR_1R_2(CR_3R_4)_nCO— \quad I$$

wherein in Formula I $R_1$, $R_2$, $R_3$, and $R_4$ are independently selected from the group consisting of a hydrogen atom and a $C_{1-4}$ alkyl radical and n is 0 or an integer from 1 to 5 which comprises coating said web with a solution comprising from 5 to 25 weight % of said binder in an organic solvent.

19. The process according to claim 18, wherein said binder comprises a homopolymer of Formula I wherein n is 0, and one of $R_1$ and $R_2$ is a hydrogen atom and the other is a methyl radical.

20. The process according to claim 18, wherein said binder comprises a copolymer or blend comprising from 70 to 10 weight % of monomer residues of Formula I wherein n is 0, and one of one of $R_1$ and $R_2$ is a hydrogen atom and the other is a methyl radical and from 30 to 90 weight % of monomer residues of Formula I wherein n is 1.

21. The process according to claim 18, wherein said binder comprises a copolymer comprising from 70 to 30 weight % of monomer residues of Formula I wherein n is 0, and one of $R_1$ and $R_2$ is a hydrogen atom and the other is a methyl radical and from 30 to 70 weight % of monomer residues of Formula I wherein n is 0, and both $R_1$ and $R_2$ are hydrogen atoms.

22. A process for impregnating a cellulosic web with binder comprising one or more polymers having a molecular weight of greater than 30,000 comprising the residues of one or more monomers of the Formula:

$$—OCR_1R_2(CR_3R_4)_nCO— \quad I$$

wherein in Formula I $R_1$, $R_2$, $R_3$, and $R_4$ are independently selected from the group consisting of a hydrogen atom and a $C_{1-4}$ alkyl radical and n is 0 or an integer from I to 5 which comprises coating said web with an aqueous dispersion comprising from 20 to 70 weight % of said binder.

23. The process according to claim 22, wherein said binder comprises a polymer of Formula I wherein n is 0, and one of $R_1$ and $R_2$ is a hydrogen atom and the other is a methyl radical.

24. The process according to claim 22, wherein said binder comprises a copolymer or blend comprising from 70 to 10 weight % of monomer residues of Formula I wherein n is 0, and one of one of $R_1$ and $R_2$ is a hydrogen atom and the other is a methyl radical and from 30 to 90 weight % of monomer residues of Formula I wherein n is 1.

25. The process according to claim 22, wherein said binder comprises a copolymer comprising from 70 to 30 weight % of monomer residues of Formula I wherein n is 0, and one of $R_1$ and $R_2$ is a hydrogen atom and the other is a methyl radical and from 30 to 70 weight % of monomer residues of Formula I wherein n is 0, and both $R_1$ and $R_2$ are hydrogen atoms.

26. A process for coating a cellulosic web with binder comprising one or more polymers having a molecular weight of greater than 30,000 comprising the residues of one or more monomers of the Formula:

$$—OCR_1R_2(CR_3R_4)_nCO— \quad I$$

wherein in Formula I $R_1$, $R_2$, $R_3$, and $R_4$ are independently selected from the group consisting of a hydrogen atom and a $C_{1-4}$ alkyl radical and n is 0 or an integer from 1 to 5 which comprises laminating to said web a film of said binder.

27. The process according to claim 26, wherein said binder comprises a polymer of Formula I wherein n is 0, and one of $R_1$ and $R_2$ is a hydrogen atom and the other is a methyl radical.

28. The process according to claim 26, wherein said binder comprises a copolymer or blend comprising from 70 to 10 weight % of monomer residues of Formula I wherein n is 0, and one of one of $R_1$ and $R_2$ is a hydrogen atom and the other is a methyl radical and from 30 to 90 weight % of monomer residues of Formula I wherein n is 1.

29. The process according to claim 26, wherein said binder comprises a copolymer comprising from 70 to 30 weight % of monomer residues of Formula I wherein n is 0, and one of $R_1$ and $R_2$ is a hydrogen atom and the other is a methyl radical and from 30 to 70 weight % of monomer residues of Formula I wherein n is 0, and both $R_1$ and $R_2$ are hydrogen atoms.

30. A process for coating a cellulosic web with binder comprising one or more polymers having a molecular weight of greater than 30,000 comprising the residues of one or more monomers of the Formula:

$$—OCR_1R_2(CR_3R_4)_nCO— \quad I$$

wherein in Formula I $R_1$, $R_2$, $R_3$, and $R_4$ are independently selected from the group consisting of a hydrogen atom and a $C_{1-4}$ alkyl radical and n is 0 or an integer from 1 to 5 which comprises extrusion coating said web with said binder.

31. The process according to claim 30, wherein said binder comprises a polymer of Formula I wherein n is 0, and one of $R_1$ and $R_2$ is a hydrogen atom and the other is a methyl radical.

32. The process according to claim 30, wherein said binder is a copolymer or blend comprising from 70 to 10 weight % of monomer residues of Formula wherein n is 0, and one of one of $R_1$ and $R_2$ is a hydrogen atom and the other is a methyl radical and from 30 to 90 weight % of monomer residues of Formula I wherein n is 1.

33. The process according to claim 31, wherein said binder comprises a copolymer comprising from 70 to 30 weight % of monomer residues of Formula I wherein n is 0, and one of $R_1$ and $R_2$ is a hydrogen atom and the other is a methyl radical and from 30 to 70 weight % of monomer residues of Formula I wherein n is 0, and both $R_1$ and $R_2$ are hydrogen atoms.

* * * * *